United States Patent [19]

Raksanyi et al.

[11] 4,372,604

[45] Feb. 8, 1983

[54] STOWABLE ARMREST TABLE ASSEMBLY

[75] Inventors: William Raksanyi, Hammond; Ronald W. Marsh, Michigan City, both of Ind.

[73] Assignee: Pullman Incorporated, Chicago, Ill.

[21] Appl. No.: 194,193

[22] Filed: Oct. 6, 1980

[51] Int. Cl.[3] ..... A47B 83/02

[52] U.S. Cl. ..... 297/162; 297/145

[58] Field of Search ..... 297/162, 155, 1,5; 108/129, 132; 248/188.6

[56] References Cited

U.S. PATENT DOCUMENTS

| | | | |
|---|---|---|---|
| 2,921,825 | 1/1960 | Spiegel | 108/132 |
| 3,215,467 | 11/1965 | McFarland et al. | 297/162 X |
| 3,408,104 | 10/1968 | Raynes | 297/162 |
| 3,491,706 | 1/1970 | Glass | 248/188.6 |
| 3,583,760 | 6/1971 | McGregor | 297/155 |

FOREIGN PATENT DOCUMENTS

| | | | |
|---|---|---|---|
| 755261 | 9/1933 | France | 297/155 |

*Primary Examiner*—Francis K. Zugel

[57] ABSTRACT

A seat armrest assembly which can be moved from an upright to a stowed position is secured to the armrest of a seating unit. The table assembly includes a support bar which extends through a support sleeve having an internal contour. A table portion is attached to the bar at one end and a blocking piece is attached at the other end. A retaining members, secured to the bar intermediate of the ends, is shaped to correspond to the internal contour of the sleeve. In the upright position the retaining member abuts the inner edges of the sleeve to prevent axial rotation of the bar, thus retaining the assembly upright. The assembly is lowered by disengaging the retaining member from the sleeve and rotating the bar-table through 90° to the stowed position.

5 Claims, 7 Drawing Figures

STOWABLE ARMREST TABLE ASSEMBLY

BACKGROUND OF THE INVENTION

1. Field of the Invention

The field of the invention pertains to railway passenger car compartments having a convertible seat and bed unit therein. More particularly, it relates to an armrest table assembly, mounted on the side of the convertible unit, which can be easily brought into an upright position or moved to a stowed position.

2. Description of the Prior Art

The prior art is exemplified by U.S. Pat. No. 2,664,943, Jan. 5, 1954; U.S. Pat. No. 3,371,956, Mar. 5, 1968; U.S. Pat. No. 3,408,104, Oct. 29, 1968 and U.S. Pat. No. 3,506,303, Apr. 14, 1970. The above patents show various types of armrest table assemblies which are movable from an upright position to a down position. The subject invention is an improvement over these designs.

SUMMARY OF THE INVENTION

The invention relates to a stowable armrest table assembly for a seating unit having an armrest, the assembly including a support sleeve having an internal contour secured to a side of the armrest, a support bar extending through the sleeve, a table portion secured to one end of the bar, blocking means on the other end of the bar to prevent movement of the other end through the sleeve and a retaining member fixed to the bar intermediate of the ends, the retaining member having a shape corresponding to the interior profile of the sleeve.

An object of the invention is to provide an armrest table which can be constructed in a simple and economical manner.

It is a further object of the invention to provide an armrest table which can be stowed inconspicuously and will not impede the movements of a person in the seat.

It is a still further object of the invention to construct an armrest table which is quickly and easily movable from an upright position to a stowed position and conversely from a stowed to an upright position.

It is an advantage of the invention that the armrest table assembly includes few peices and is therefore economical to manufacture.

Other objects and advantages of the invention will become apparent from the drawings and the following description of the invention.

DESCRIPTION OF THE PREFERRED EMBODIMENT

Figure 1:
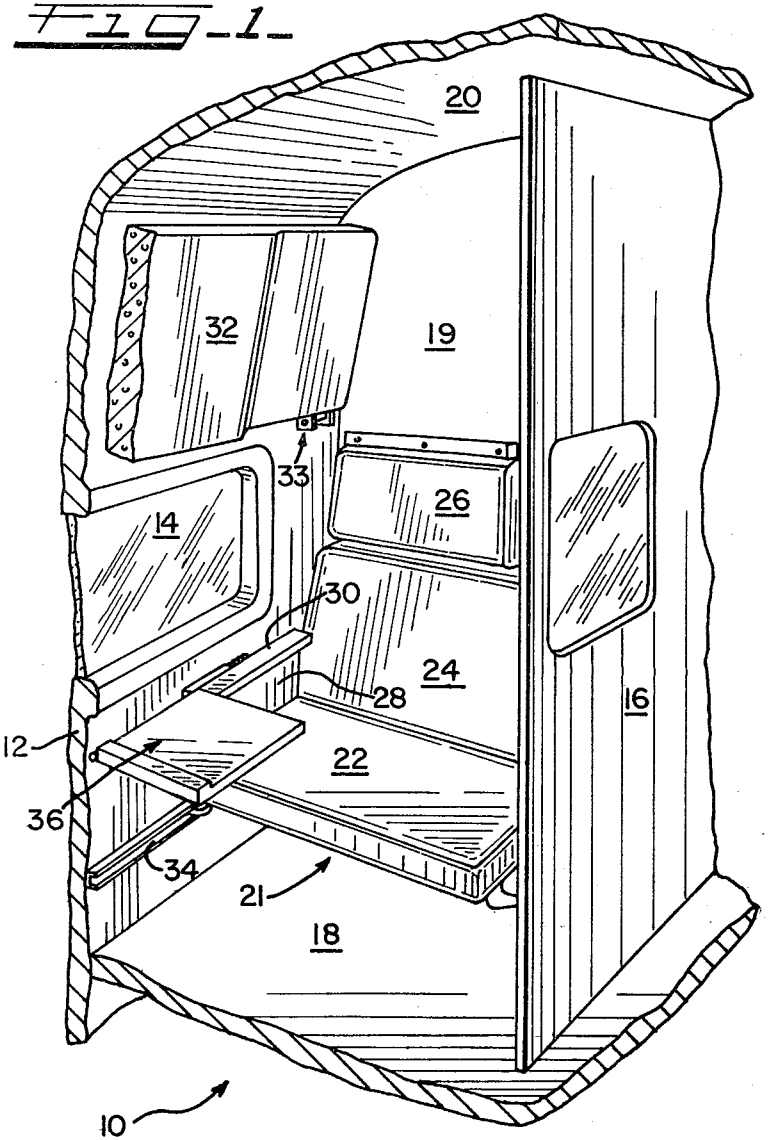
FIG. 1 is a partial perspective view of a railway passenger compartment embodying the present invention.

As shown in FIG. 1, the present invention is embodied in a railway passenger car compartment, designated generally at 10, only one-half being shown; the compartment 10 is defined by an outside car wall 12 and a partition wall 16 which separates the compartment 10 from the railway car aisle. The compartment 10 is further defined by a floor 18, a rear wall 19 and a roof 20.

A convertible seat and bed unit 21 is formed from a seat cushion 22 which is hingedly attached to a back cushion 24. A head cushion 26 is secured to the wall 19 for use when the convertible unit 21 is in the upright position, as shown in the figure. An armrest panel 28 is attached to the side of the cushion 22 adjacent the wall 12 and supports an armrest 30. A stowable armrest table assembly 36, to be described more fully hereinafter, is shown in an upright position attached to the side of the armrest 30 adjacent the wall 12.

The convertible unit 21 is supported in the compartment 10 by a track 34 mounted on the side wall 12 and another track not shown, but substantially identical to the track 34, mounted on the partition wall 16. The hinged connection between the seat 22 and the back 24 is such that when the seat is moved along the tracks 34 away from the rear wall 19, the back 24 will be angularly displaced from a vertical to a horizontal orientation. When in the horizontal position, the unit 21 mates with a complementary unit on the other half of the compartment to form a lower sleeping berth. One half of an upper sleeping berth 32 is mounted on the side wall 12 by hinges 33 above window 14. The berth 32 is held in a stowed position adjacent the side wall 12 by any suitable means such as a latch or lever. The berth 32 is brought into the horizontal plane by releasing the latch means and pivoting the berth around the hinges 33.

The other half of the passenger car compartment is substantially a mirror image of the half described. It includes a convertible seat and bed unit which complements the unit 21 to form a full lower sleeping berth and the other half of the upper sleeping berth 32. A doorway or entrance to the compartment lies in the vertical plane of the partition wall 16 between the wall 16 and its counterpart in the other half of the compartment.

The armrest table assembly 36 is shown in FIG. 1; in the upright position. The table portion 38 of the assembly forms a continuous extension of the armrest 30 and is above the vertical level of the seat 22 to allow sufficient room for the legs of a passember to fit comfortably under the table.

Figure 2:
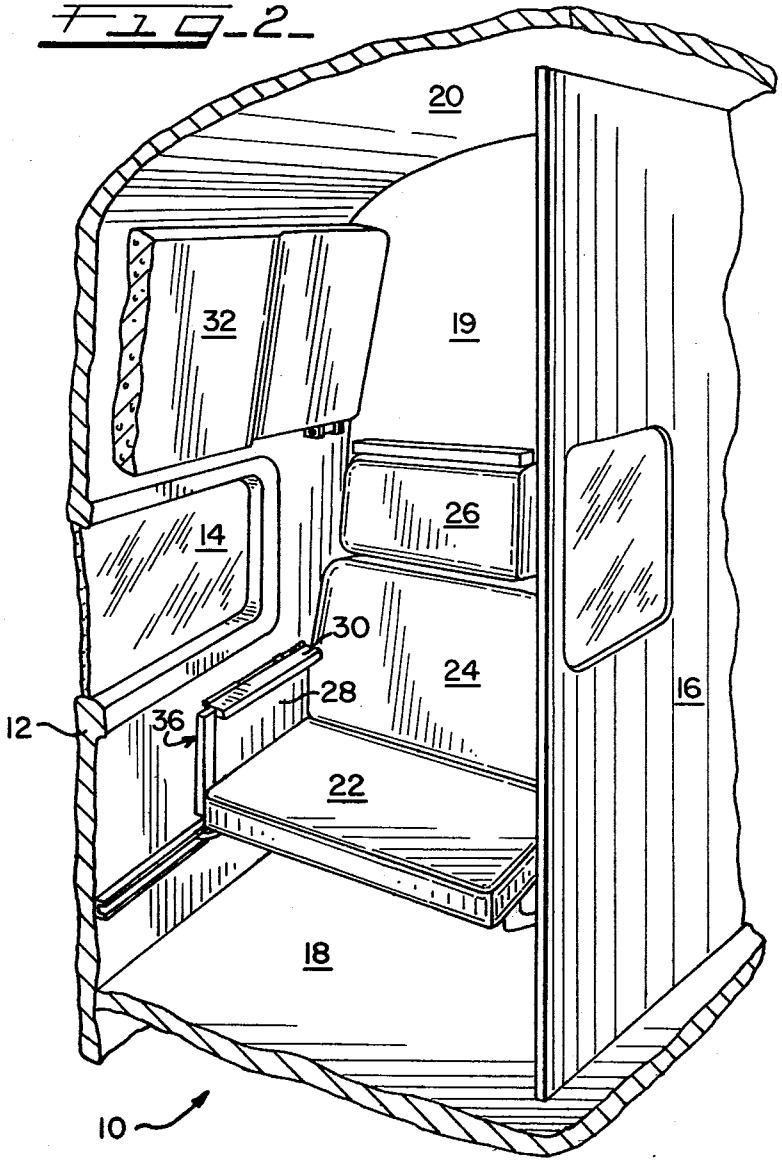
FIG. 2 is a perspective view similar to FIG. 1 but showing the armrest table assembly in a stowed position.

FIG. 2 is a view of one half of a passenger car compartment, substantially identical to FIG. 1, but showing the armrest table assembly 36 in a stowed position. The front edge of the table assembly 36 is slightly set back from the front of the seat cushion 22 such that the assembly 36 is inconspicuous and will not impede the movements of a passenger. The location of the assembly 36 allows the unit 21 to be easily moved along the tracks 34 to form a lower berth.

Figure 3:
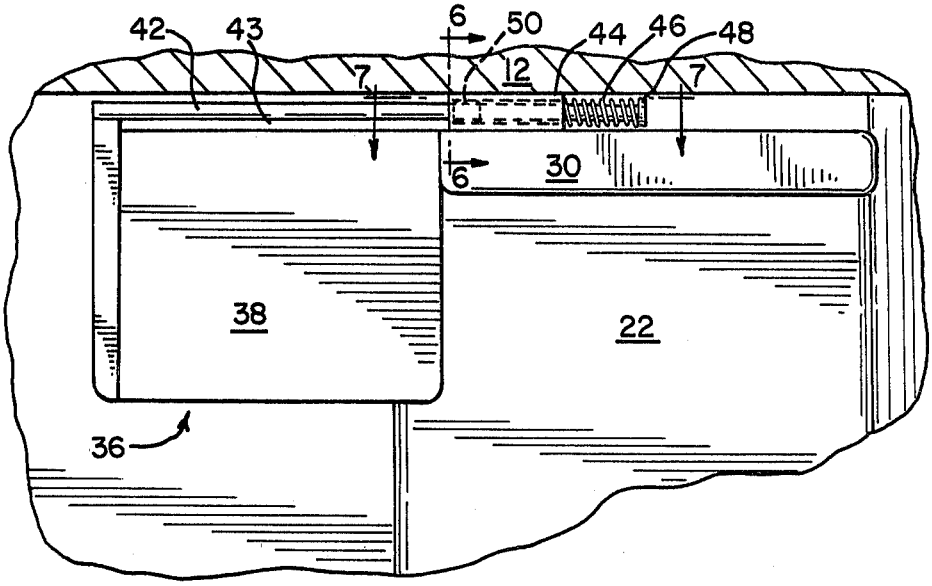
FIG. 3 is a top view of an armrest for a railway seat in an upright position.

Referring now to FIG. 3, the stowable armrest table assembly 36 is shown in its open or upright position, horizontally aligned with the armrest 30. The assembly 36 includes a generally rectangular table portion 38 which terminates on one side at an integral ledge portion 40 and a support bar 42 which holds the table 38 in an upright position. The table portion 38 and ledge portion 40 are preferably made of wood, but can be of any appropriate material such as metal, molded plastic or the like. The ledge portion 40 is fastened to the support bar 42 in any appropriate manner such as welding, screw fastening or bracketing. The attachment of the support bar 42 at the ledge portion 40 is the only connection between the table 38 and the bar 42. A space 43 is thus defined between the bar 42 and the table 38 for reasons which will become clear.

The support bar 42 is limited to longitudinal movement along its axis by passing through a support sleeve 44 which is mounted in the space between the side wall 12 and the armrest 30. The sleeve 44 is at least long enough to prevent any substantial angular displacement of the bar 42. The interior profile of the sleeve 44 is preferably square, but may be of any polygonal shape which has a number of sides equal to a multiple of four. At the rearward end of the bar 42 a compression spring 46 encircles the bar 42 and is prevented from movement off the end of the bar 42 by a retaining washer 48. The compression spring is preferably a coil spring, but may be any suitable type of compression spring. The diameter of the spring 46 is at least as large as the cross-sectional dimension of the sleeve 44 so that the end of the bar 42 is prevented from moving completely through the sleeve 44.

A retaining member 50 is fixedly secured to the bar 42 intermediate the ends. The member 50 has an exterior profile which corresponds to the inner cross-sectional shape of the sleeve 44. The member 50 is preferably a metal casting and is welded to the bar 42 but may be a plastic piece glued to the bar 42.

The assembly 36 is held in the upright position, as shown in FIG. 3, by the action of the retaining member 50 abutting the inner surfaces of the sleeve 44. This prevents any rotation of the bar 42 as long as the number 50 is inside the sleeve 44. The stability of the table 38 is enhanced by the rearward force exerted on the bar 42 by the spring 46. This force causes the table 38 to abut the armrest 30 and also prevents the retaining member 50 from moving out of the sleeve.

Figure 4:
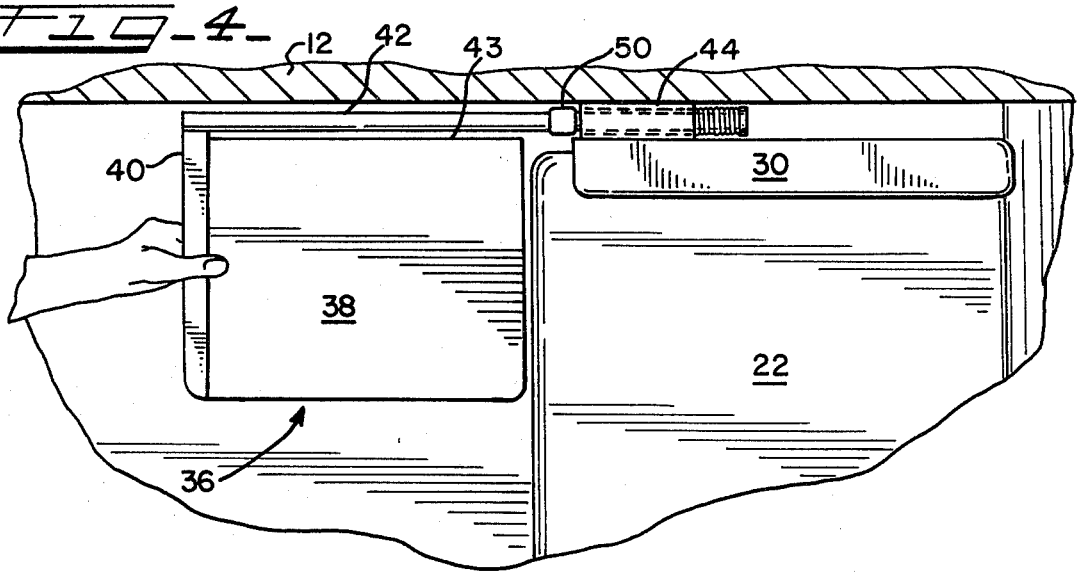
FIG. 4 is a top view of the armrest in a partially opened position.

As shown in FIG. 4, the stowable armrest table assembly 36 is lowered by pulling the table 38 forward to a position whereby the retaining member 50 is outside and forward of the sleeve 44. The table 38 is then rotated downward around the axis of the bar 42 through 90/0/ until it is in a vertical orientation adjacent the side wall 12. By the axial rotation of the bar 42, the edges of the member 50 are again brought into alignment with the edges of the sleeve 44, thus allowing the member 50 to pass rearwardly through the sleeve 44. The space 43 allows the table 38 to move rearwardly with the bar 42 by letting the sleeve 44 pass in the space 43 until it abuts connection of the ledge portion 40.

Figure 5:
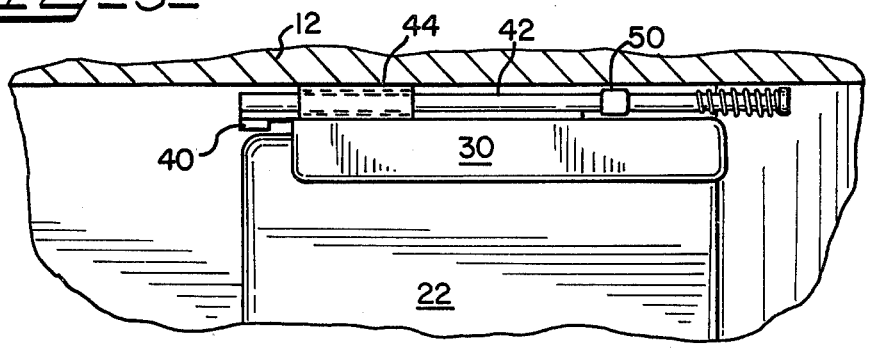
FIG. 5 is a top view of the armrest in the stowed position.

The table 38 can now be moved to the stowed position, as shown in FIG. 5, by moving the bar 42 rearwardly through the sleeve 44 such that the table 38 lies in the space between the wall 12 and the armrest panel 28. When the armrest assembly 36 is in the fully stowed position, the ledge portion 40 of the table 38 rests adjacent the front edge of the seat cushion 22 and above the track 34 so that the assembly 36 is neither objectionable in appearance or in terms of passenger comfort. Whemn the convertible unit 21 is moved forward to form a lower berth, the armrest table assembly 36, in the stowed position, moveswith the armrest panel 28 and armrest 30 along the tracks 34.

Figure 6:
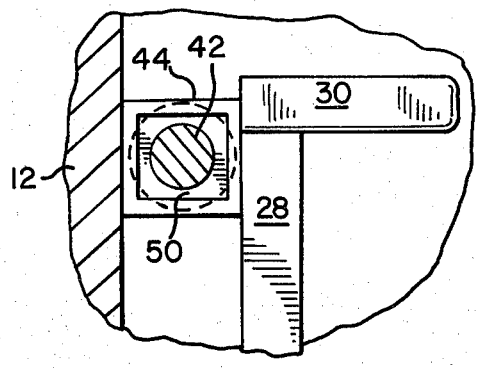
FIG. 6 is a cross-sectional view taken along the line 6—6 of FIG. 3.

FIG. 6, a cross-sectional view taken along the line 6—6 in FIG. 3, shows the engagement of the inner surfaces of the sleeve 44 with the sides of the retaining member 50 when the assembly 36 is in an upright position. The tolerance between the sides of the member 50 and the inner edges of the sleeve 44 is such that the member 50 can pass longitudinally through the sleeve 44 but will not allow any significant axial rotation of the bar 42 when the member 50 is in the sleeve 44.

Figure 7:
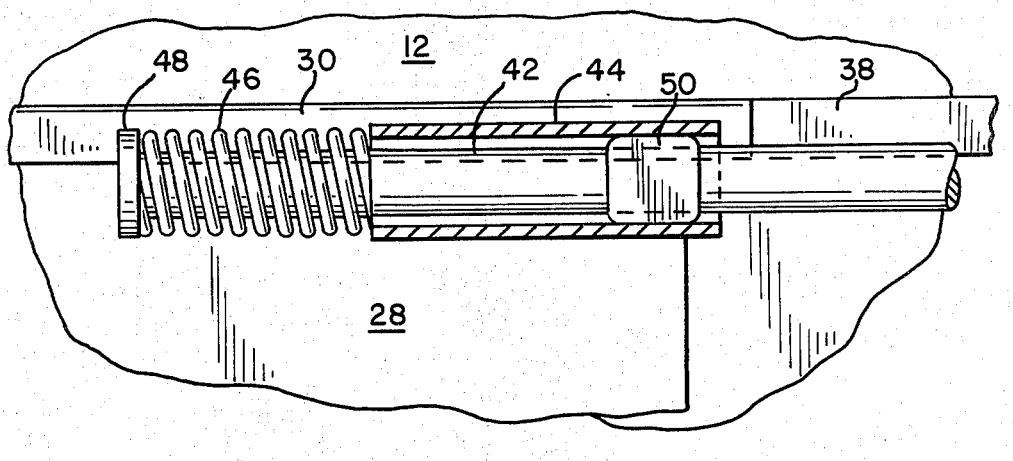
FIG. 7 is a cross-sectional view taken along the line 7—7 of FIG. 3.

FIG. 7, is a cross-sectional view taken along the line 7—7 of FIG. 3 further showing the engagement of the sleeve 44 and the member 50 when the assembly 36 is in the upright position. The action of the spring 46 brings the inner edge of the table 38 into abutting relation with the forward end of the armrest 30 to form a continuous surface from the armrest 30 to the table 38. Further, the spring force prevents the member 50 moving out of the sleeve 44 unless a force opposite to that of the spring is applied.

Inasmuch as the invention is subject to many modifications, revisions and changes in detail, it is intended that all matter contained in the foregoing description or shown in the accompanying drawings shall be interpreted as illustrative and not in a limiting sense.

What is claimed is:

1. A stowable armrest table assembly movable from a stowed, non-use position to an upright, use position for a seating unit having an armrest, said assembly comprising a support sleeve having an internal contour secured to a side of the armrest;

a support bar extending through the sleeve;

a platform assembly having a table portion spaced from said support bar to define a space having a width greater than the thickness of said support sleeve and a ledge portion at the upper end of said table portion secured to said support bar at one end thereof;

blocking means on the other end of the bar to prevent movement of said other end through the sleeve;

a retaining member fixed to the bar intermediate of the ends, said retaining member having a shape corresponding to the interior profile of the sleeve and said retaining member not being within said support sleeve and said blocking means not being in contact with said sleeve when said platform assembly is in said non-use position and said retaining member being within said support sleeve and said blocking means being in operational contact with said sleeve when said platform assembly is in said use position.

2. The assembly as claimed in claim 1, wherein the interior profile of the support sleeve is square.

3. The assembly as claimed in claim 1 or 2 wherein the blocking means is a retaining washer.

4. The assembly as claimed in claim 3, wherein said blocking means further comprises a compression spring located around the periphery of the bar adjacent the retaining washer.

5. A stowable armrest table assembly movable from a stowed, non-use position to an upright, use position for a train passenger car compartment having a seating unit with an armrest, said assembly comprising a support sleeve having a square internal contour, said support sleeve being mounted adjacent the outside edge of said armrest;

a support bar extending through the sleeve alongside the armrest;

a platform-assembly having a table portion spaced from said support bar to define a space having a width greater than the thickness of said support sleeve and a ledge portion at the upper end of said table portion secured to said support bar at one end thereof;

a coil spring encircling the bar adjacent the other end of said bar, said spring having a diameter larger than the width of said internal contour to prevent the passage of the spring therethrough;

a retaining washer fixed to said other end of said bar for maintaining the spring thereon;

a square retaining member fixed to said bar intermediate of the ends, said member having a width less than the width of said internal contour to allow passage of the member therethrough when the sides of the member are aligned with the sides of the internal contour and said square retaining member not being within said support sleeve and said coil spring being at an at rest position when said armrest is in said non-use position and said square retaining member being within said support sleeve and said coil spring being in compression to maintain said square retaining member within said support sleeve in said use position.

* * * * *